US005758745A

United States Patent [19]

Beggs et al.

[11] Patent Number: 5,758,745

[45] Date of Patent: Jun. 2, 1998

[54] EXTENSION LADDER, COMBINATION END CAP/GUIDE BRACKET, AND METHOD FOR CLIMBING

[75] Inventors: Robert D. Beggs, Fredonia; Mitchell H. Hetrich, Greenville; Christine A. Leipheimer, Jamestown; Marc A. Mabie, Sharon, all of Pa.

[73] Assignee: Werner Co., Greenville, Pa.

[21] Appl. No.: 685,191

[22] Filed: Jul. 18, 1996

[51] Int. Cl.[6] ..... E06C 7/06

[52] U.S. Cl. ..... 182/207; 182/208; 182/213

[58] Field of Search ..... 182/207, 208, 182/209, 210, 211, 212, 213

[56] References Cited

U.S. PATENT DOCUMENTS

| | | | |
|---|---|---|---|
| 3,464,522 | 9/1969 | Kramer | 182/211 |
| 3,502,173 | 3/1970 | Arnold | 182/211 |

FOREIGN PATENT DOCUMENTS

| | | | |
|---|---|---|---|
| 234146 | 6/1961 | Australia | 182/207 |

*Primary Examiner*—Alvin C. Chin-Shue
*Assistant Examiner*—Long Dinh Phan
*Attorney, Agent, or Firm*—Ansel M. Schwartz

[57] ABSTRACT

An extension ladder comprises a base section comprising a first base rail, a second base rail in spaced relationship and in parallel with the first base rail, and at least a first base rung connected to the first base rail and the second base rail. The extension ladder also comprises a fly section slidably connected to the base section. The fly section comprises a first fly rail, a second fly rail in spaced relationship and in parallel with the first fly rail, at least a first fly rung connected to the first fly rail and the second fly rail, a first combination end cap/guide bracket connected to the bottom of the first fly rail, and a second combination end cap/guide bracket connected to the bottom of the second fly rail. Each end cap/guide bracket is one continuous piece. The first fly rail is adjacent to and in parallel with and in spaced relationship with said first base rail. The second fly rail is adjacent to and in parallel with and in spaced relationship with said second base rail. The first and second combination end cap/guide bracket prevents the fly section separating from the base section and capping the bottom end of the first fly rail and second fly rail, respectively. A combination end cap/guide bracket comprises a back wall. Additionally, the end cap/guide bracket comprises an end closure portion preferably with a slot connected to the back wall. The end cap/guide bracket also comprises a hook portion having a hook connected to the back wall and extending perpendicularly from the end closure portion. Additionally, the end cap/guide bracket comprises a block portion which is disposed adjacent and in parallel with the hook of the hook portion and preferably defines a first channel with the hook.

14 Claims, 11 Drawing Sheets

EXTENSION LADDER, COMBINATION END CAP/GUIDE BRACKET, AND METHOD FOR CLIMBING

FIELD OF THE INVENTION

The present invention is related to an extension ladder. More specifically, the present invention is related to an extension ladder that has a combination end cap/guide bracket.

BACKGROUND OF THE INVENTION

Extension ladders typically have end caps placed on the bottom end of the rails of the fly section (extending section). These end caps may have slots in them to allow the respective flange of the base section to pass through the respective end cap as the fly section is moved relative to the base section to extend the overall length of the extension ladder. Also part of prior art extension ladders are guide brackets which are connected to the rails of the fly section. The respective flange of the respective rail of the base section is fitted to extend through the guide bracket. The guide bracket maintains the alignment of the respective rail and thus the fly section with the base section during movement and also prevents a fly section separating from the base section by the fly section moving horizontally or vertically relative to the base section. FIGS. 1 and 2 show portions of a prior art extension ladder having a prior art end cap and a prior art guide bracket. The guide bracket is separate and apart from the end cap. The guide bracket is also typically an aluminum extrusion.

The present invention combines the end cap with the guide bracket into one piece so the guide bracket and the end cap are placed on the extension ladder during manufacture in one step.

SUMMARY OF THE INVENTION

The present invention pertains to an extension ladder. The extension ladder comprises a base section comprising a first base rail, a second base rail in spaced relationship and in parallel with the first base rail, and at least a first base rung connected to the first base rail and the second base rail. The extension ladder also comprises a fly section slidably connected to the base section. The fly section comprises a first fly rail, a second fly rail in spaced relationship and in parallel with the first fly rail, at least a first fly rung connected to the first fly rail and the second fly rail, a first combination end cap/guide bracket connected to the bottom of the first fly rail, and a second combination end cap/guide bracket connected to the bottom of the second fly rail. Each end cap/guide bracket is one continuous piece. The first fly rail is adjacent to and in parallel with and in spaced relationship with said first base rail. The second fly rail is adjacent to and in parallel with and in spaced relationship with said second base rail. The first and second combination end cap/guide bracket prevents the fly section separating from the base section and caps the bottom end of the first fly rail and second fly rail, respectively.

The present invention pertains to a combination end cap/guide bracket. The combination end cap/guide bracket comprises a back wall. Additionally, the end cap/guide bracket comprises an end closure portion preferably with a slot connected to the back wall. The end cap/guide bracket also comprises a hook portion having a hook connected to the back wall and extending perpendicularly from the end closure portion. Additionally, the end cap/guide bracket comprises a block portion which is disposed adjacent and in parallel with the hook of the hook portion and preferably defines a first channel with the hook.

The present invention pertains to a method for climbing. The method comprises the steps of moving a fly section along a base section while being engaged with the base section by sliding a first channel that is connected to an end closure portion attached at the end of each fly rail of the fly section along the flange of each respective base rail of the base section to a desired portion relative to the base rail. Then, there is the step of placing the fly section and connected base section upright against a support but at an angle relative to the support.

BRIEF DESCRIPTION OF THE DRAWINGS

In the accompanying drawings, the preferred embodiment of the invention and preferred methods of practicing the invention are illustrated in which.

DESCRIPTION OF THE PREFERRED EMBODIMENT

Figure 1:
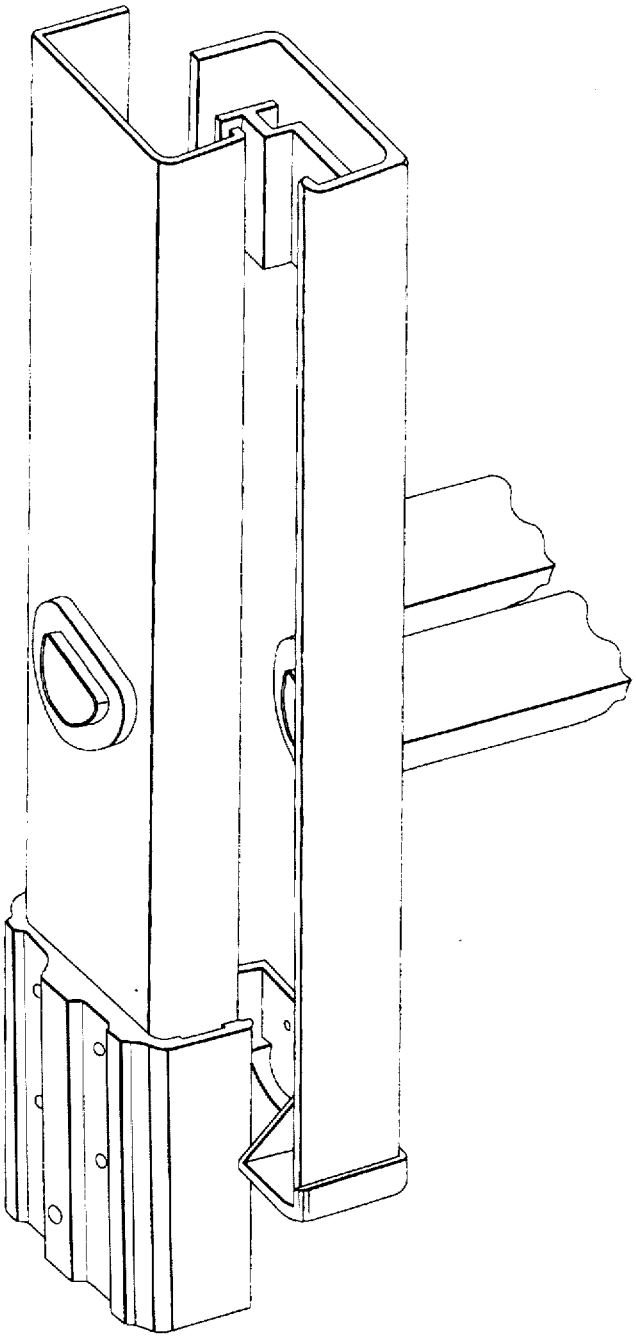
FIG. 1 PRIOR ART
FIG. 1 is a schematic representation of a prior art guide bracket and end cap which are separated from each other.
Figure 2:
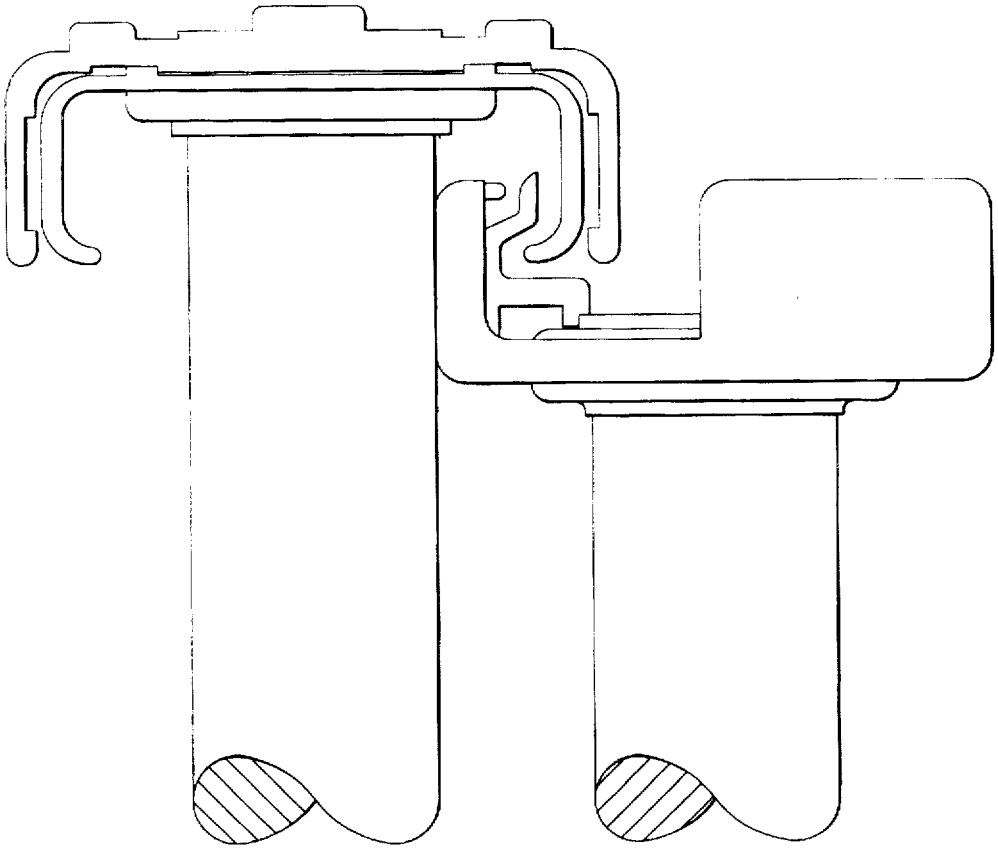
FIG. 2 PRIOR ART
FIG. 2 is a schematic representation of a bottom view of an extension ladder having the prior art end cap and guide bracket which are separated from each other.
Figure 3:
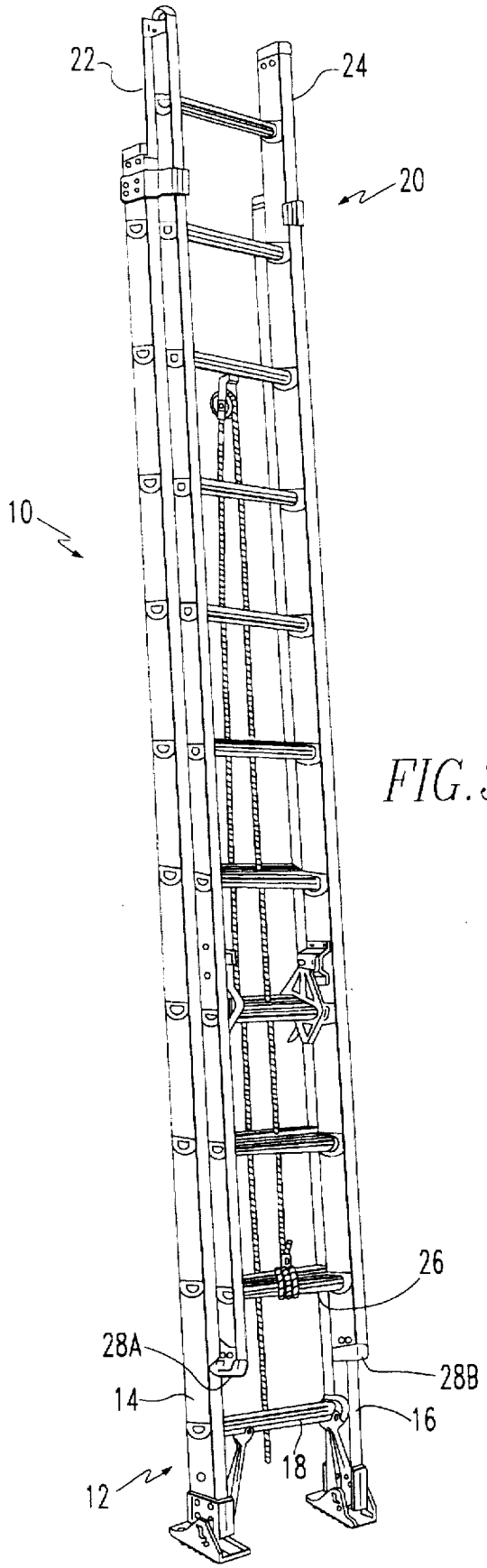
FIG. 3 is a schematic representation of a perspective view of an extension ladder of the present invention.

Referring now to the drawings wherein like reference numerals refer to similar or identical parts throughout the several views, and more specifically to figure thereof, there is shown an extension ladder 10. The extension ladder 10 comprises a base section 12 comprising a first base rail 14, a second base rail 16 in spaced relationship and in parallel with the first base rail 14, and at least a first base rung 18 connected to the first base rail 14 and the second base rail 16. The extension ladder 10 also comprises a fly section 20 slidably connected to the base section 12. The fly section 20 comprises a first fly rail 22, a second fly rail 24 in spaced relationship and in parallel with the first fly rail 22, at least a first fly rung 26 connected to the first fly rail 22 and the second fly rail 24, a first combination end cap/guide bracket 28*a* connected to the bottom of the first fly rail 22, and a second combination end cap/guide bracket 28*b* connected to the bottom of the second fly rail 24. Each end cap/guide bracket is one continuous piece. The first fly rail 22 is adjacent to and in parallel with and in spaced relationship with said first base rail 14. The second fly rail 24 is adjacent to and in parallel with and in spaced relationship with said second base rail 16. The first and second combination end cap/guide brackets prevent the fly section 20 separating from the base section 12 and cap the bottom end 30 of the first fly rail 22, and second fly rail 24, respectively.

Each end cap/guide bracket preferably comprises a guide bracket portion 27 which engages with a respective base rail to maintain the respective base rail in connection and in alignment with the fly rail to which the guide bracket portion 27 is attached. The guide bracket portion 27 preferably comprises a first portion 32 which prevents the respective fly rail to which the end cap/guide bracket is connected separating from the respective adjacent base rail in a horizontal direction. The guide bracket portion 27 preferably also comprises a second portion 34 which prevents the respective fly rail to which the end cap/guide bracket is connected separating from the respective adjacent base rail in a vertical direction.

Preferably, the second portion 34 comprises a hook portion 36 having a hook 38. The hook portion is in parallel and in relation with the respective adjacent base rail such that the hook 38 hooks with the flange 42 of the respective adjacent base rail.

The first portion 32 preferably comprises a block portion 44 which engages the hook portion and extends along the hook portion 36. The block portion 44 and the hook of the hook portion 36 preferably define a first channel 46 in which the return 40 of the inner flange 42 of the respective adjacent rail (for those ladders whose side rails have returns) is disposed and moves relative to the combination end cap/guide bracket when the fly section 20 moves relative to the base section 12. The vertical side of block 44 in FIG. 4 of each combination end cap/guide bracket 28*a* and 28*b* (when the respective combination end cap/guide rail moves toward the adjacent base rail) is contacted by a return on either rail 14 or 16 (or the tip of flange 42 for rails without returns) of the respective adjacent base rail when the fly section 20 moves horizontally toward the respective base rail relative to the base section 12 and prevents the fly section 20 from moving horizontally enough distance so the fly section 20 separates from the base section 12. (The combination end cap/guide bracket closest to the base rail which the fly section moves away from does not contact such base rail.) Vertical upward movement is prevented when hook 38 contacts the underside of flange 42. Downward movement is prevented by contact between the fly rails and base rungs.

Each combination end cap/guide bracket also comprises an end closure portion 48 preferably with a slot 50 connected with the first channel 46. The end closure portion 48 contacts the bottom end 30 of the inner flange 42, outer flange 52 and web 54 of the respective fly rail and the ends therebetween. The end closure portion 48 is perpendicular with the hook portion 36. The combination end cap/guide bracket slides along the respective adjacent rail through the slot 50 when the fly section 20 moves relative to the base section 12 in a direction parallel to the base and fly rails. Preferably, each end cap/guide bracket comprises a buttress 62 which extends from the end closure portion 48 and is disposed alongside the slot 50. The buttress 62 is in parallel with the first and second walls.

It should be noted that not all extension ladders 10 require a slot 50 for the respective base rail to pass through as the fly section 20 is moved relative to the base section 12. In regard to extension ladders 10 whose rails are all oriented such that the flanges are directed inward toward the center of the extension ladder 10, no slot 50 in the respective combination end cap/guide bracket 28 is needed. Instead, the end closure portion 48 is one solid continuous piece with no slot 50, and the guide bracket portion 27, with, for instance, the first portion 32 and second portion 34, is disposed on the outside of the first side wall 58. In this way, the guide bracket portion 27 aligns with the respective flange of the respective base rail of the base section 12 to guide the fly section 20 relative to the base section 12 and maintain the fly and base sections together.

Referring back to the depicted end cap/guide bracket 28, preferably, each end cap/guide bracket comprises a back wall 56 which connects with the web 54 of the respective fly rail. The hook portion 36 extends from the back wall 56. Preferably, the hook portion 36 extends perpendicularly from the back wall 56 and comprises a first side wall 58 which contacts the outer flange 52 of the respective fly rail. Preferably, each end cap/guide bracket also comprises a second side wall 60 which extends from the back wall 56, and contacts the inner flange 42 of the respective fly rail. The first side wall 58 is in parallel, and opposes and is in spaced relationship with the second wall 60. Preferably, the block portion 44 contacts the back wall 56 and the hook portion 36. The end closure portion 48 preferably extends from the back wall 56, and the first and second walls contact the end closure portion 48. Each end cap/guide bracket is preferably made of plastic.

The present invention pertains to a combination end cap/guide bracket. The combination end cap/guide bracket comprises a back wall 56. Additionally, the end cap/guide bracket comprises an end closure portion 48 preferably with a slot 50 connected to the back wall 56. The end cap/guide bracket also comprises a hook portion 36 having a hook 38 connected to the back wall 56 and extending perpendicularly from the end closure portion 48. Additionally, the end cap/guide bracket comprises a block portion 44 which is disposed adjacent and in parallel with the hook 38 of the hook portion 36 and preferably defines a first channel 46 with the hook 38. The channel 46 is only needed if the base rail has a return, although it can still be used if there is no return.

The present invention pertains to a method for climbing. The method comprises the steps of moving a fly section 20 along a base section 12 while being engaged with the base section 12 by sliding a first channel 46 that is connected to an end closure portion 48 attached at the end of each fly rail of the fly section 20 along the return 40 of each respective base rail of the base section 12 to a desired portion relative to the base rail. Then, there is the step of placing the fly section 20 and connected base section 12 upright against a support 64 but at an angle relative to the support 64.

In the operation of the preferred embodiment, a first combination end cap/guide bracket 28*a* is connected with the bottom end 30 of a first fly rail 22. The first combination end cap/guide bracket 28*a* is connected to the bottom end 30 of the first fly rail 22 by the back wall 56 contacting the web 54 of the first fly rail 22. The first side wall 58 and the second side wall 60 which opposes the first side wall 58 contact the inner flange 42 and the outer flange 52 respectively of the bottom end 30 of the first fly rail 22 and rivets penetrate through the back wall 56 and the web 54 of the first fly rail 22 causing the first combination end cap/guide bracket 28*a* to become fixed and attached to the bottom end 30 of be first fly rail 22.

When the first combination end cap/guide bracket 28*a* is properly fixed to the bottom end 30 of the first fly rail 22 a ridge 66 which extends from the first side wall 58, second side wall 60 and back wall 56 in a continuous manner, aligns with the bottom end 30 of the inner flange 42, outer flange 52 and web 54 respectively and essentially forms a smooth closure between the bottom end 30 of the first fly rail 22 and the end closure portion 48 of the first combination end cap/guide bracket 28*a*. In this way, the bottom end 30 of the first fly rail 22 is properly protected from damage from objects contacting the bare exposed bottom end 30 of either the web 54, inner flange 42 or outer flange 52. In the same way, the second combination end cap/guide bracket 28*b* is fixed and attached to the bottom end 30 of the second fly rail 24.

After the first combination end cap/guide bracket 28*a* and the second combination end cap/guide bracket 28*b* are fixed to the first fly rail 22 and the second fly rail 24, respectively, the fly section 20 is placed adjacent to the base section 12 so the bottom of the first fly rail 22 and the bottom of the second fly rail 24 aligns with the top of the first base rail 14 and the top of the second base rail 16, respectively. The fly section 20 is then moved over the base section 12 with the inner flange 42 of the first base rail 14 and second base rail 16 fitting over and engaging with the outer flange 52 of the first fly rail 22 and second fly rail 24, respectively. In this way, the fly section 20 engages with and connects with the base section 12 since the inner flange 42, web 54 and outer flange 52 of each base rail oppose the inner flange 42, web 54 and outer flange 52 of a respective fly rail with the inner flange 42 of the respective base rail overlapping with the outer flange 52 of the respective fly section 20. In other words, the first base rail 14 and the second base rail 16 of the base section 12 faces inward towards the first base rung 18 while the first fly rail 22 and second fly rail 24 faces outward away from the first fly rung 26.

Figure 4:
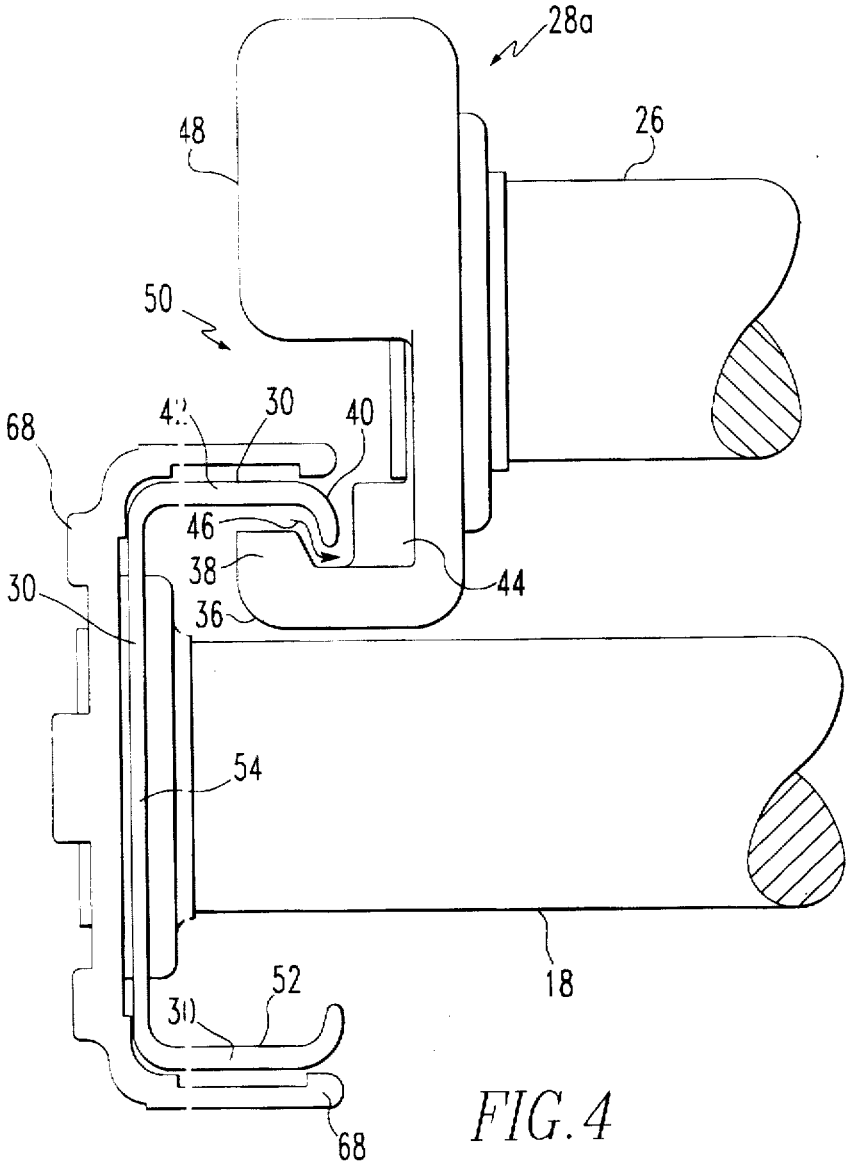
FIG. 4 is a schematic representation of a bottom view of a portion of the extension ladder with a combination end cap/guide bracket.
Figure 5:
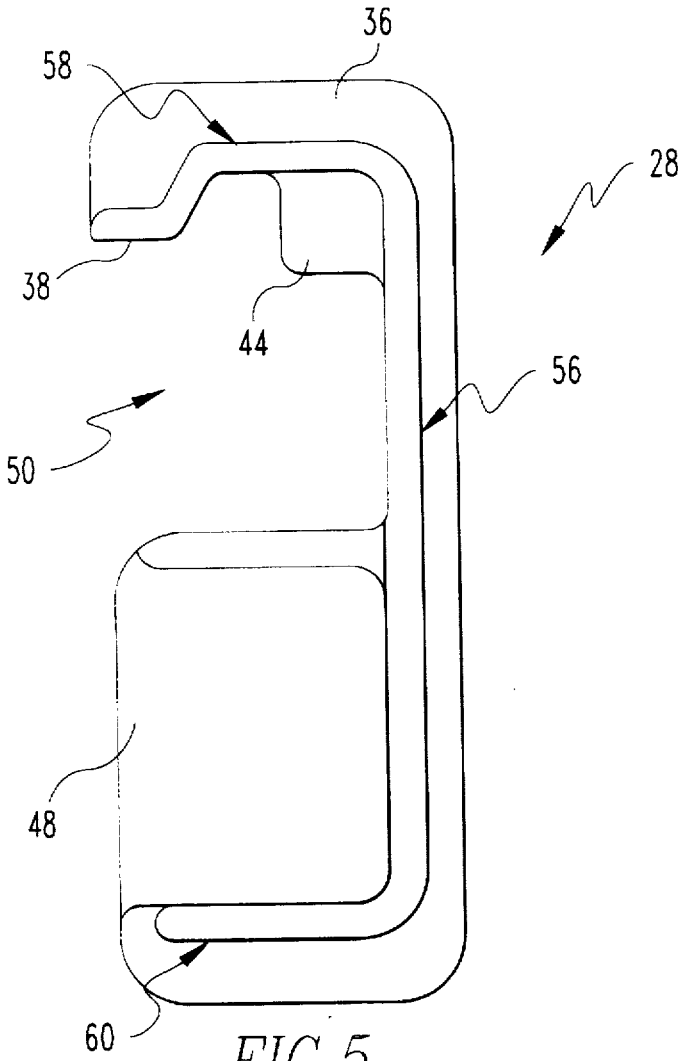
FIG. 5 is a schematic representation of a bottom view of a combinaton end cap/guide bracket.
Figure 6:
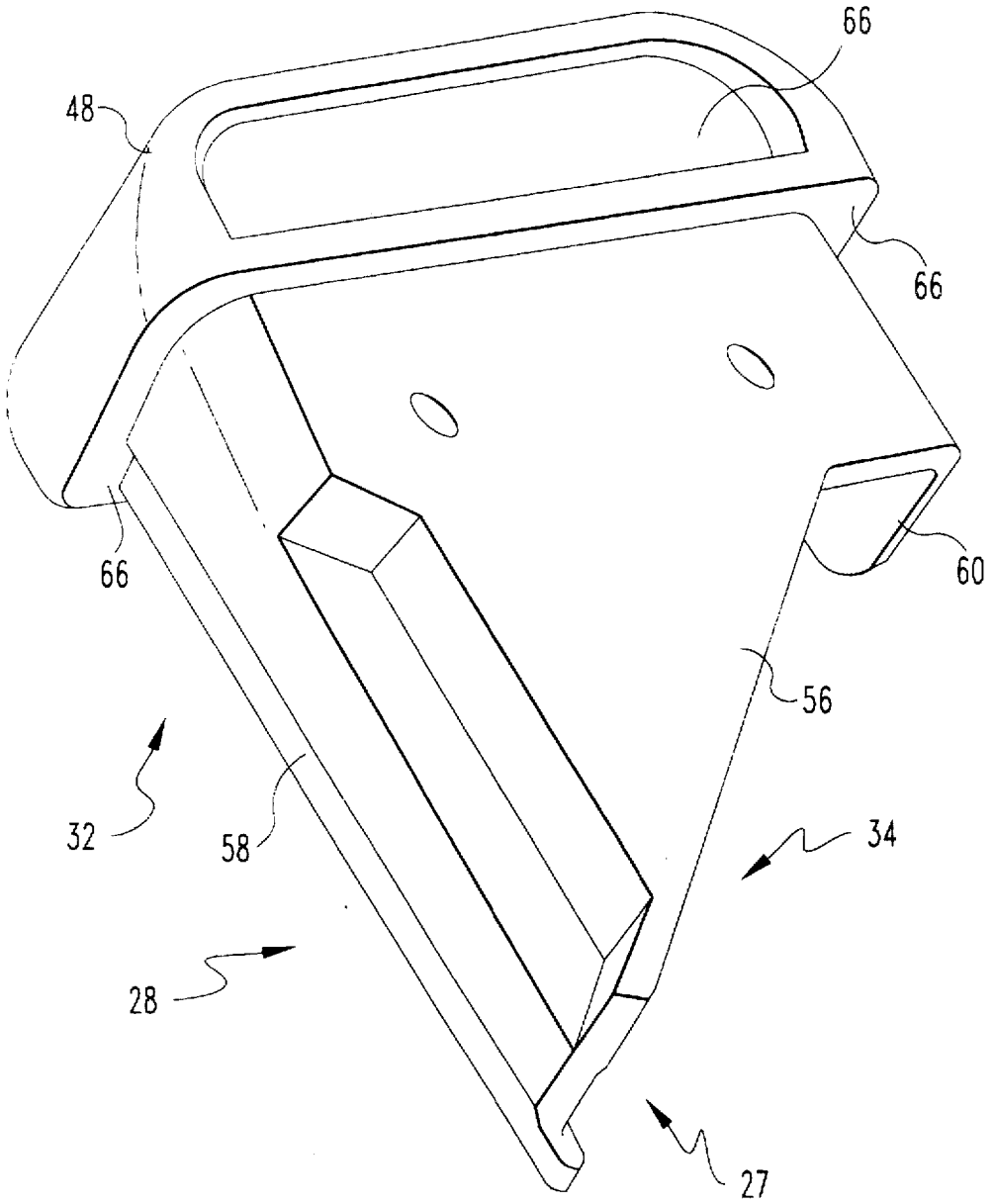
FIG. 6 is a schematic representation of a perspective view of the back of the combination end cap/guide bracket.
Figure 7:
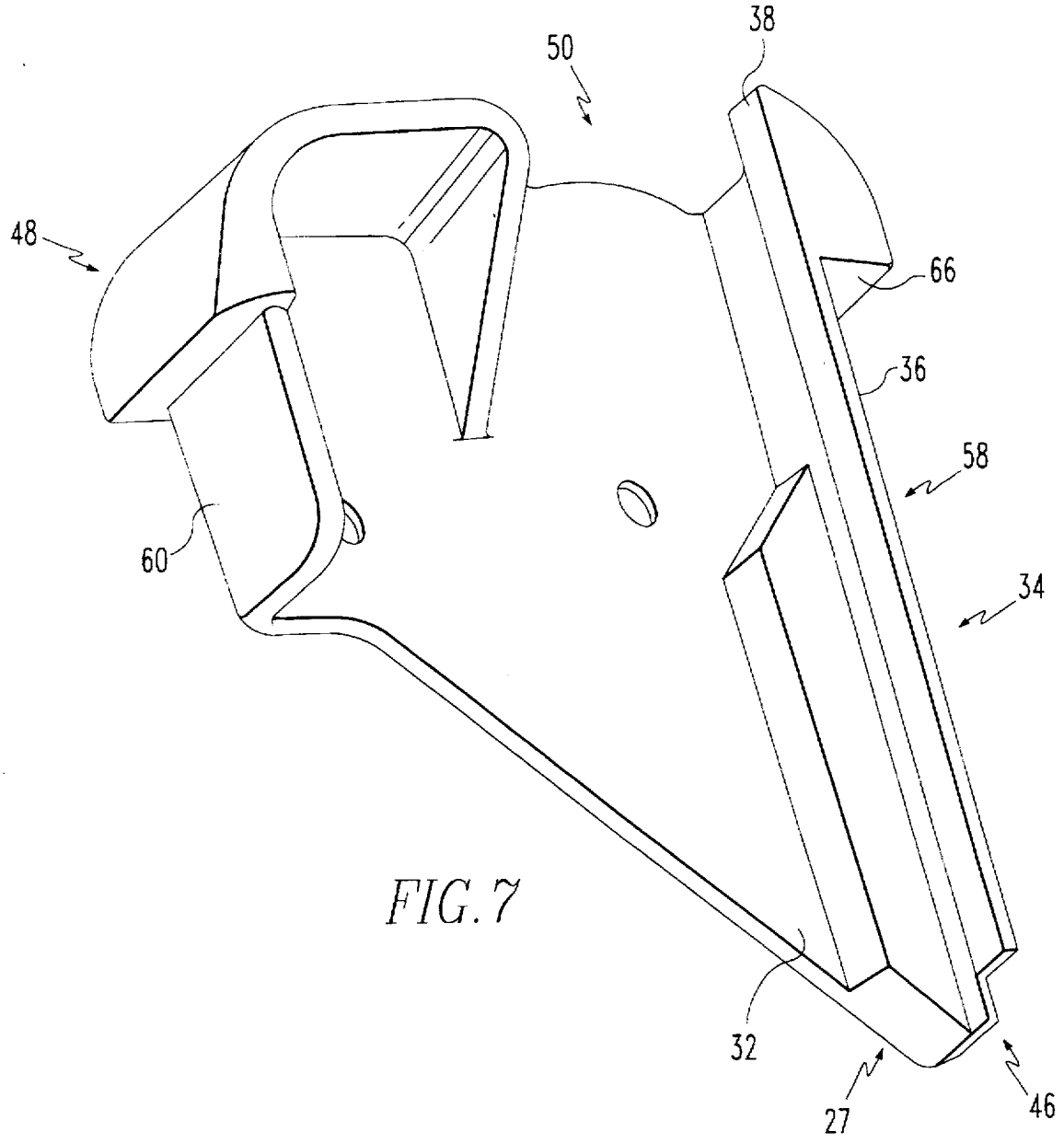
FIG. 7 is a schematic representation of a perspective front view of the combination end cap/guide bracket.
Figure 8:
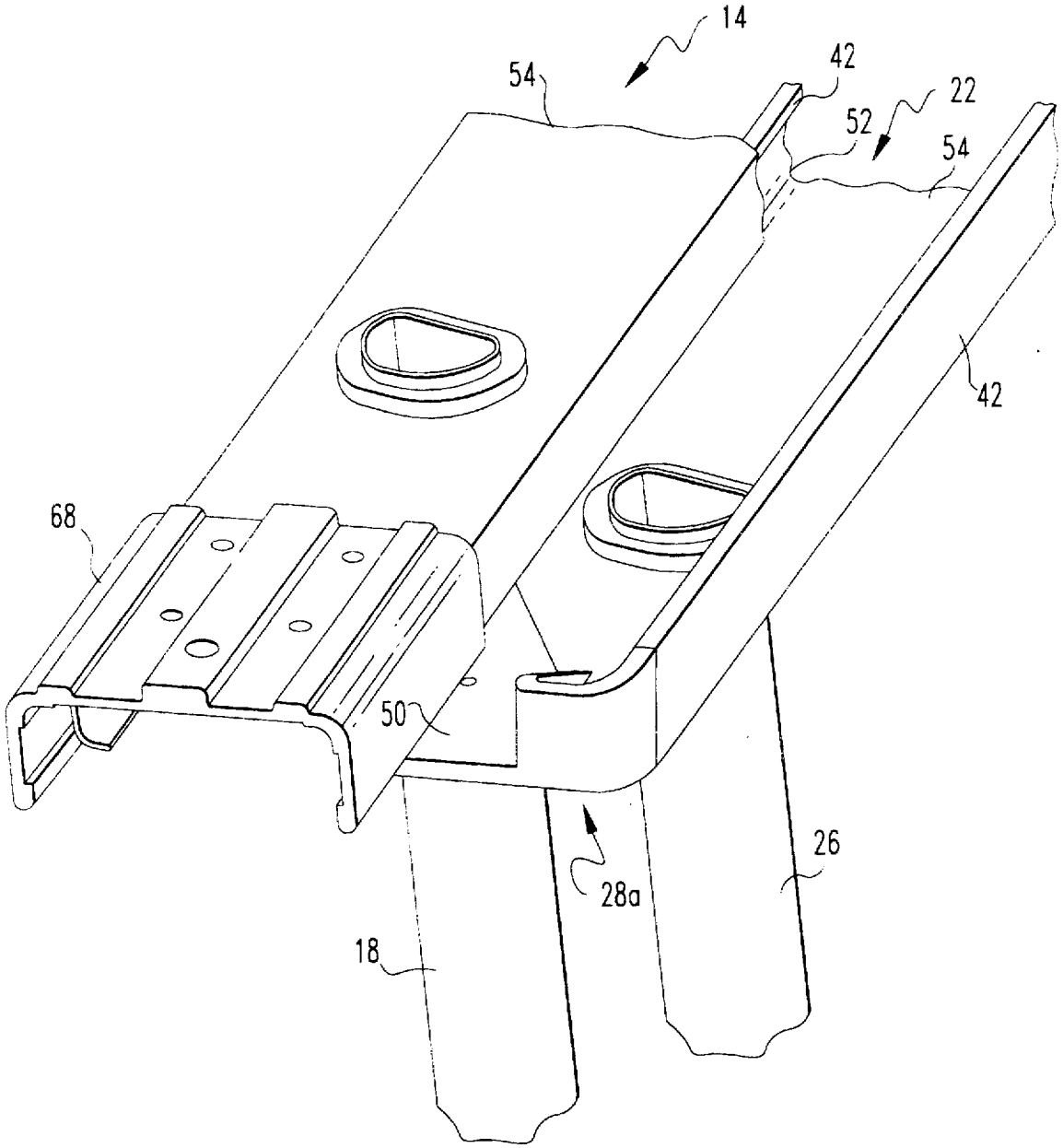
FIG. 8 is a schematic representation of a perspective side view of an extension portion of an extension ladder with a combination end cap/guide bracket.
Figure 9:
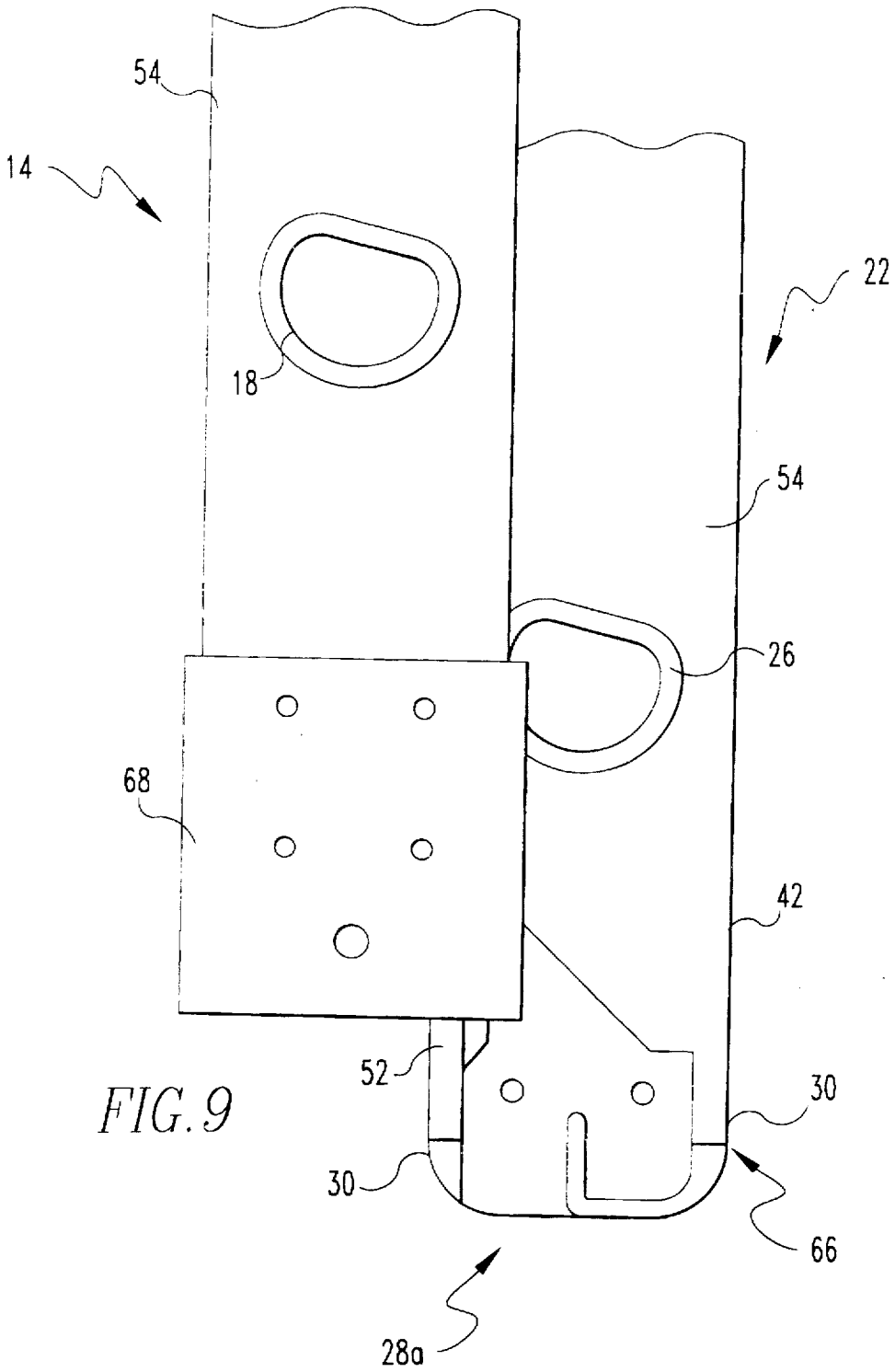
FIG. 9 is a schematic representation of a side view of a portion of an extension ladder with a combination end cap/guide bracket.
Figure 10:
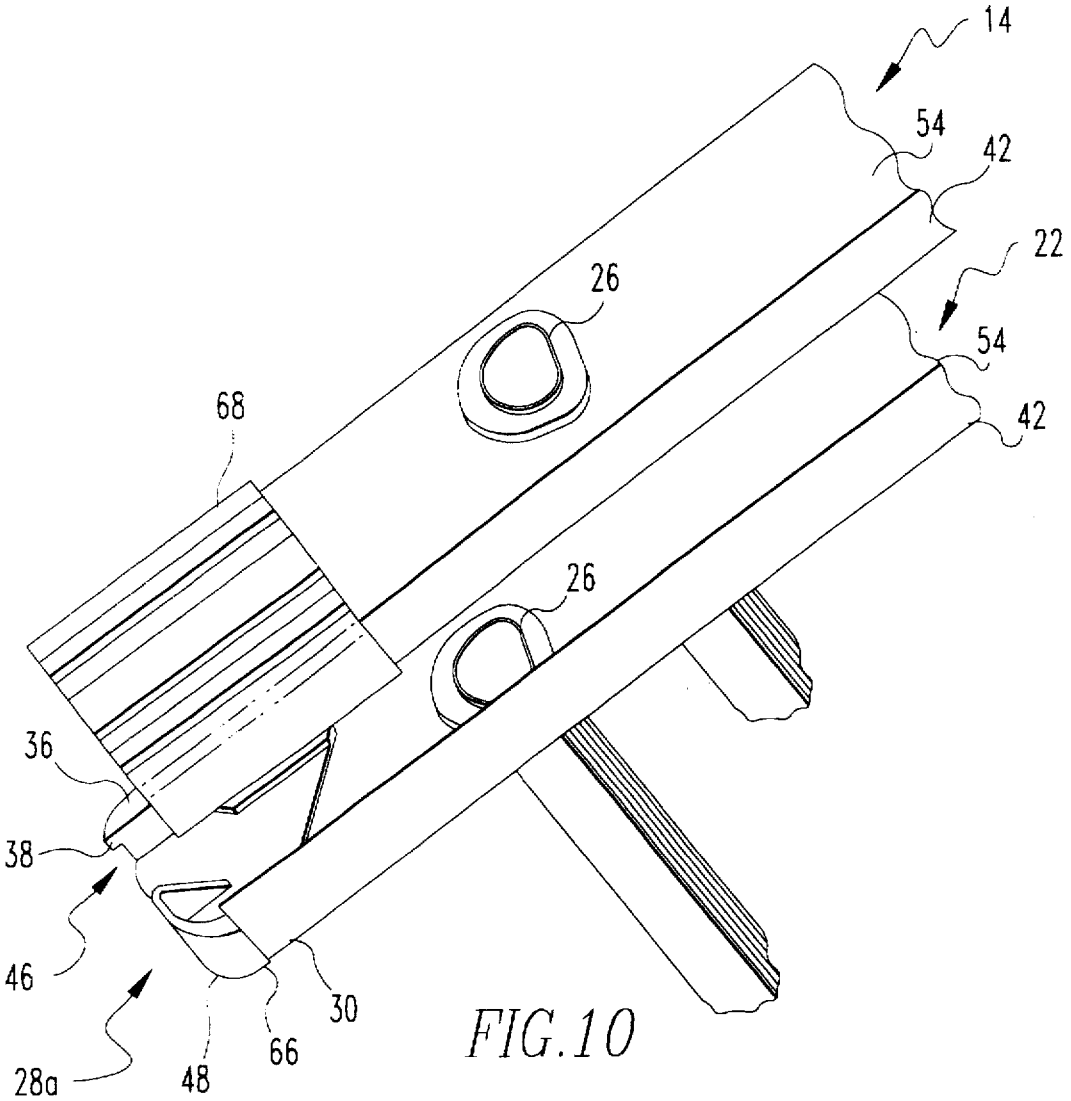
FIG. 10 is a schematic representation of a perspective view of a portion of a combination end cap/guide bracket.

As the respective fly rail is fitted with the respective base rail, the bottom end 30 of the respective base rail, which has a base rail guard 68, engages with the respective combination end cap/guide bracket. (It should be noted that while the FIG. 4 shows the base rail guard 68 with a return, the base rail guard 68 can be used with the return eliminated.) Specifically, the return 40 of the inner flange 42 of the first base rail 14 fits into the first channel 46 of the first combination end cap/guide bracket 28*a*. The first channel 46 has a hook 38 and a block portion 44 which opposes the hook 38 and which together define the first channel 46. The return 40 of the inner flange 42 of the first fly rail 22 opposes the hook 38. In the same way, the return 40 of the inner flange 42 of the second base rail 16 fits into the first channel 46 of the second combination end cap/guide bracket 28*b*.

During use, when the extension ladder 10 is to be lengthened by the fly section 20 moving relative to the base section 12, the fly section 20 moves along the base section 12, towards the top of the base section 12 and away from the bottom of the base section 12. As the fly section 20 moves to lengthen the extension ladder 10, the first channel 46 moves along the return 40 of the respective rail. Additionally, the bottom end 30 of the return 40 and the inner flange 42 as well as the inner flange 42 of the base rail guard 68 move through the respective combination end cap/guide bracket 28 by passing through the slot 50 in the end closure portion 48.

There is no combination end cap/guide bracket on either the top of the first fly rail 22 or the second fly rail 24 since the top of the first fly rail 22 and second fly rail 24 extend above and do not engage the first base rail 14 and second base rail 16, respectively, as the extension ladder 10 is lengthened. Thus, the respective combination end cap/guide bracket would not engage the respective base rail and would serve no purpose during most uses of the extension ladder 10, and in all instances when the fly section 20 has been moved to lengthen the extension ladder 10.

The presence of the slot 50 in the combination end cap/guide bracket allows the respective rail of the base section 12 to move unimpeded relative to the respective rail of the fly section 20 as the fly section 20 is moved relative to the base section 12.

If the fly section 20 is lifted up in a vertical direction away from the base section 12, or if the fly section 20 is caused to be moved in a vertical direction away from the base section 12, the hook 38 and the hook portion 36 of the first fly rail 22 and the second fly rail 24 contact the return 40 and the inner flange 42 of the first base rail 14 and second base rail 16, respectively, and the fly section 20 is prevented from separating from the base section 12. If the fly section 20 is moved in a horizontal direction relative to the base section 12, for instance in a direction towards the first base rail 14 and away from the second base rail 16, then the block portion 44 of the first combination end cap/guide bracket 48 contacts the return 40 of the inner flange 42 of the first base rail 14. By the return 40 contacting the block portion 44, it stops the movement of the fly section 20 relative to the base section 12 before the return 40 of the opposite base rail has cleared the hook 38 of the respective combination end cap/guide bracket. In this way, the fly section 20 cannot slide horizontally apart from the base section 12.

Each combination end cap/guide bracket is made of plastic. The advantage of the combination end cap/guide bracket being of plastic is that the wear on the respective return 40 and inner flange 42 of the respective base rail due to friction from contact with the respective hook 38 or hook portion 36 during movement of the fly section 20 relative to the base section 12 is decreased relative to the wear of the prior art aluminum guide bracket against the respective return 40 and inner flange 42 of the respective base rail. Additionally, by the combination end cap/guide bracket being one continuous piece, the time it takes to build the extension ladder 10 is reduced. No longer do 2 separate pieces, the end cap and the guide bracket have to be separately attached to the respective fly rail. In one step, the combination end cap/guide bracket is attached to the respective rail.

Figure 13:
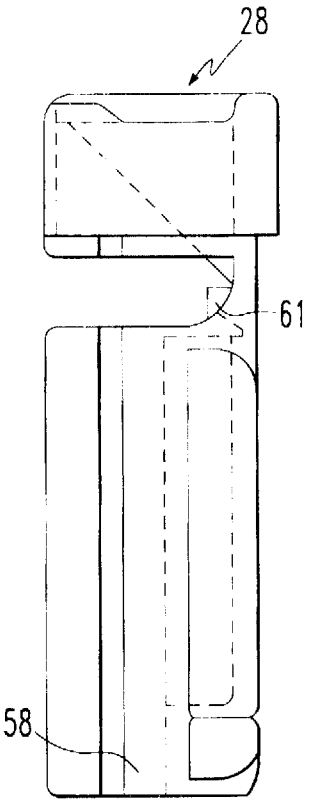
FIG. 13 is a schematic representation of a side view of an alternative embodiment of the combination end cap/guide bracket of the present invention.
Figure 12:
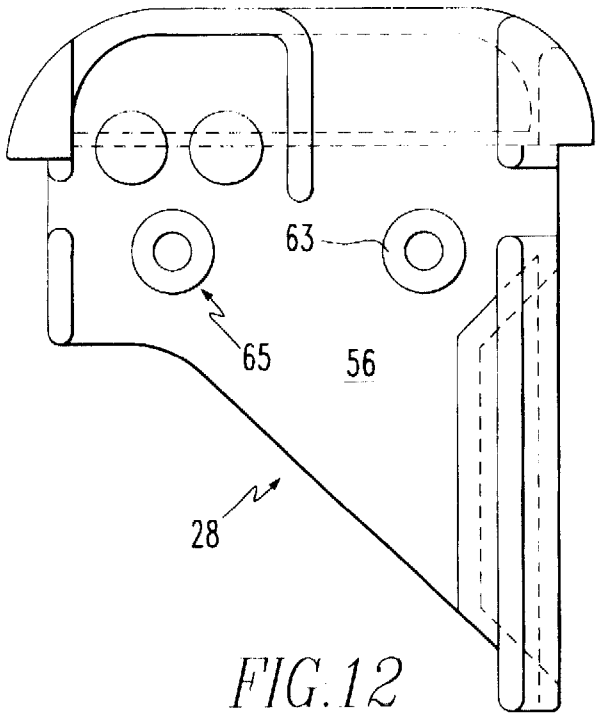
FIG. 12 is a schematic representation of a front view of the alternative embodiment of the combination end cap/guide bracket of the present invention.
Figure 11:
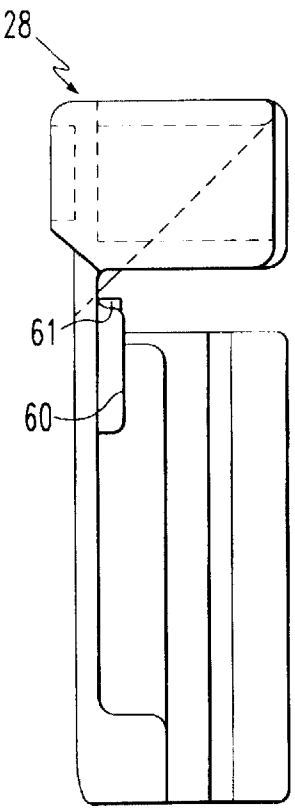
FIG. 11 is a schematic representation of a side view of an alternative embodiment of the combination end cap/guide bracket of the present invention.

In an alternative preferred embodiment of the combination end cap/guide bracket 28, as shown in FIGS. 11–13, the first wall 58 and the second wall 60 have a wall slot 61. The wall slot 61 improves the cold impact performance of the end cap/guide bracket 28. During colder weather, typically below about 32 degrees Fahrenheit, there is an increased likelihood that the combination end cap/guide bracket 28 will crack and break during an impact. The presence of the wall slot 61 in the first wall 58 and the second wall 60 does not prevent the combination end cap/guide bracket from breaking during impact, but controls how it breaks. In the event the combination end cap/guide bracket 28 breaks, the presence of the wall slots 61 cause the break to occur between the end closure portion 38 and the guide bracket portion 27. If there is breakage, then the endbut thre portion 48 typically breaks away but the guide bracket portion 27 remains to continue to allow the fly section 20 and base section 12 to be maintained in alignment and connection. Furthermore, the remaining guide bracket portion 27 is completely protected by the ladder rails of the fly section. The breakage occurs between the end closure portion 48 and the guide bracket portion 27 because material has been essentially thinned or removed along the juncture between the end closure portion 48 and the guide bracket portion 27 so when there is force from an impact, the break occurs along the weakest point, that is, where there is least material to withstand the force. The point where there is least material is along where the wall slots 61 are disposed. Additionally, to further protect the integrity of the combination end cap/guide bracket 28 the rivet holes 63 have thickened walls 65 surrounding them to prevent a crack from entering the rivet holes 63 and allowing the back wall 56 to separate from the respective rail.

Although the invention has been described in detail in the foregoing embodiments for the purpose of illustration, it is to be understood that such detail is solely for that purpose and that variations can be made therein by those skilled in the art without departing from the spirit and scope of the invention except as it may be described by the following claims.

What is claimed is:

1. An extension ladder comprising:

a base section comprising a first base rail, a second base rail in spaced relationship and in parallel with the first base rail, and at least a first base rung connected to the first base rail and the second base rail; and a fly section slidably connected to the base section, said fly section comprising a first fly rail, a second fly rail in spaced relationship and in parallel with the first fly rail, at least a first fly rung connected to the first fly rail and the second fly rail, a first combination end cap/guide bracket connected to the bottom end of the first fly rail, and a second combination end cap/guide bracket connected to the bottom of the second fly rail, each end cap/guide bracket in one continuous piece, said first fly rail adjacent to and in parallel with and in spaced relation with said first base rail, said second fly rail adjacent to and in parallel with and in spaced relation with said second base rail, said first and second combination end cap/guide bracket preventing the fly section separating from the base section and capping the bottom end of the first fly rail and second fly rail, respectively.

2. The extension ladder as described in claim 1 wherein each end cap/guide bracket comprises a first portion which prevents the respective fly rail to which the end cap/guide bracket is connected separating from the respective adjacent base rail in a horizontal direction, and a second portion which prevents the respective fly rail to which the end cap/guide bracket is connected separating from the respective adjacent base rail in a vertical direction.

3. The extension ladder as described in claim 1 wherein each base rail has an inner flange with a return and wherein the second portion comprises a hook portion having a hook, said hook portion in parallel and in relation with the respective adjacent base rail such that the hook hooks with the return of the inner flange of the respective adjacent base rail.

4. The extension ladder as described in claim 1 wherein each base rail has an inner flange with a return and wherein the first portion comprises a block portion which engages the hook portion and extends along the hook portion, said block portion and said hook of said hook portion defining a first channel in which the return of the inner flange of the respective adjacent rail is disposed and moves relative to the combination end cap/guide bracket when the fly section moves relative to the base section, said block portion contacted by the return of the inner flange of the respective adjacent base rail when the fly section moves horizontally relative to the base section and prevents the fly section from moving horizontally enough distance so the fly section separates from the base section.

5. The extension ladder as described in claim 1 wherein each fly rail has an inner flange, outer flange and web and wherein each combination end cap/guide bracket also comprises an end closure portion with a slot connected with the first channel, said end closure portion contacts the bottom end of the inner flange, outer flange and web of the respective fly rail and extends therebetween, said end closure portion perpendicular with the hook portion, said combination end cap/guide bracket slides along the respective adjacent rail through the slot when the fly section moves relative to the base section in a direction parallel to the base and fly rails.

6. The extension ladder as described in claim 5 wherein each end cap/guide bracket comprises a back wall which connects with the web of the respective fly rail, said hook portion extending from said back wall.

7. The extension ladder as described in claim 6 wherein the hook portion extends perpendicularly from said back wall and comprises a first side wall which contacts the outer flange of the respective fly rail.

8. The extension ladder as described in claim 2 wherein each end cap/guide bracket comprises a second side wall which extends from the back wall, and contacts the inner flange of the respective fly rail, said first side wall in parallel, opposing and spaced relationship with the second wall.

9. The extension ladder as described in claim 8 wherein said block portion contacts said back wall and said hook portion.

10. The extension ladder as described in claim 9 wherein the end closure portion extends from the back wall, and said first and second walls contact said end closure portion.

11. The extension ladder as described in claim 10 wherein each end cap/guide bracket comprises a buttress which extends from the end closure portion and is disposed alongside said slot, said buttress in parallel with said first and second walls.

12. The extension ladder as described in claim 11 wherein each end cap/guide bracket is made of plastic.

13. A combination end cap/guide bracket comprising:

a back wall;

an end closure portion connected to the back wall;

a hook portion having a hook connected to the back wall and extending perpendicularly from the end closure portion; and a block portion which is disposed adjacent and in parallel with the hook of the hook portion.

14. A method of using a combination end cap/guide bracket with an extension ladder comprising the steps of:

a) providing the extension ladder having a base section including a first base rail, a second base rail in spaced relationship and in parallel with the first base rail, and at least a first base rung connected to the first base rail and the second base rail, and a fly section slidably connected to the base section, said fly section comprising a first fly rail, a second fly rail in spaced relationship and in parallel with the first fly rail, at least a first fly rung connected to the first fly rail and the second fly rail, said first fly rail adjacent to and in parallel with and in spaced relation with said first base rail, said second fly rail adjacent to and in parallel with and in spaced relation with said second base rail; and b) including a first combination end cap/guide bracket connected to the bottom end of the first fly rail and a second combination end cap/guide bracket connected to the bottom of the second fly rail, each end cap/guide bracket in one continuous piece, and said first and second combination end cap/guide bracket preventing the fly section separating from the base section and capping the bottom end of the first fly rail and second fly rail, respectively.

* * * * *